US009425519B2

(12) United States Patent
Wendt

(10) Patent No.: US 9,425,519 B2
(45) Date of Patent: Aug. 23, 2016

(54) ELECTRICAL CONNECTION TERMINAL

(75) Inventor: Andreas Wendt, Berlin (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 129 days.

(21) Appl. No.: 14/129,167

(22) PCT Filed: Jun. 18, 2012

(86) PCT No.: PCT/EP2012/002564

§ 371 (c)(1),
(2), (4) Date: Dec. 24, 2013

(87) PCT Pub. No.: WO2013/004343

PCT Pub. Date: Jan. 10, 2013

(65) Prior Publication Data

US 2014/0134892 A1 May 15, 2014

(30) Foreign Application Priority Data

Jul. 4, 2011 (DE) ..... 10 2011 106 432

(51) Int. Cl.
*H01R 4/50* (2006.01)
*H01R 4/52* (2006.01)

(52) U.S. Cl.
CPC ..... *H01R 4/5008* (2013.01); *H01R 4/52* (2013.01)

(58) Field of Classification Search
CPC ..... H01R 4/5008; H01R 9/24
USPC ..... 439/441, 709
See application file for complete search history.

(56) References Cited

U.S. PATENT DOCUMENTS

| | | | | |
|---|---|---|---|---|
| 5,575,695 | A | 11/1996 | De Bernardis | |
| 6,238,233 | B1 | 5/2001 | Drexler et al. | |
| 6,832,935 | B2 * | 12/2004 | Minowa | H01R 9/2608 361/759 |
| 8,176,625 | B2 * | 5/2012 | Copper | H01R 4/5091 29/749 |
| 2007/0141910 | A1 * | 6/2007 | Camino | H01R 4/4872 439/607.41 |
| 2010/0167573 | A1 * | 7/2010 | Dhandapani | H01R 4/4818 439/345 |

FOREIGN PATENT DOCUMENTS

| | | |
|---|---|---|
| CN | 201395090 | 2/2010 |
| DE | 1928580 | 12/1970 |
| EP | 0780923 | 6/1997 |
| JP | H07183059 | 7/1995 |
| WO | 9120110 | 12/1991 |
| WO | 9833235 | 7/1998 |

OTHER PUBLICATIONS

International Search Report for PCT/EP2012/002564, English Translation attached to original, Both completed by the European Patent Office on Nov. 21, 2012, All together 5 Pages.

* cited by examiner

*Primary Examiner* — Briggitte R Hammond
(74) *Attorney, Agent, or Firm* — Brooks Kushman P.C.

(57) ABSTRACT

An electrical connection terminal having a holder and a clamping lever pivotably arranged on the holder and having a clamping unit for clamping a conductor between the clamping unit and a current bar. A manual lever is provided which is pivotably accommodated on the clamping lever in order to enable a dynamic transformation ratio in the closing operation.

14 Claims, 5 Drawing Sheets

ELECTRICAL CONNECTION TERMINAL

CROSS-REFERENCE TO RELATED APPLICATION

This application is the U.S. national phase of PCT Application No. PCT/EP2012/002564 filed on Jun. 18, 2012, which claims priority to German Patent Application No. 10 2011 106 432.3 filed on Jul. 4, 2011, the disclosures of which are incorporated in their entirety by reference herein.

The present invention relates to an electrical connection terminal, and in particular to a tilting lever terminal for the connection of a conductor.

Various electrical connection terminals which are suitable for the connection of conductors even of large diameter have been disclosed in the prior art. For example, it is possible to connect conductors even having large cross sections to screw terminals. The conductor in this case is firmly clamped to the electrical connection terminal via a screw connection. However, a disadvantage of such screw terminals is that a conductor from which the insulation has been stripped cannot readily simply be pivoted in from above. In particular, in the case of large conductor cross sections and conductors of solid design, this leads to the installation being made more difficult, since the conductor has to be bent over and has to be introduced axially from the front into the screw terminal.

By contrast, the installation is easier in the case of an electrical connection terminal which permits a conductor to be connected to be pivoted in from above. As a result, the conductor to be connected can be shortened to the appropriate length beforehand and can simply be pivoted in during the installation.

It is therefore the object of the present invention to provide an electrical connection terminal which is simple to install and permits a reliable contact connection of a conductor to be connected.

This object is achieved by an electrical connection terminal with the features of claim 1.

Preferred developments of the connection terminal according to the invention are indicated in the dependent claims. Further advantages and features of the present invention emerge from the general description and from the description of an exemplary embodiment.

The electrical connection terminal according to the invention comprises at least one holder and at least one clamping lever which is arranged pivotably on said holder and has at least one clamping unit for clamping at least one conductor between the clamping unit and a current bar. A manual lever is provided, said manual lever being accommodated pivotably on the clamping lever in order to permit a dynamic transmission ratio during the closing operation and a high clamping force.

The electrical connection terminal according to the invention has a multiplicity of advantages since it provides a simple and flexible possibility of connection for electrical conductors and permits a secure contact connection. By means of the pivotably arranged clamping lever, it is possible widely to open the electrical connection terminal according to the invention such that an electrical conductor to be connected can be pivoted from above into the open connection terminal. The clamping state is subsequently brought about by pivoting of the clamping lever.

The interaction of the manual lever and of the clamping lever results in a dynamic transmission ratio, and therefore the lever transmission at the beginning of the closing operation already brings about a large movement of the clamping lever for a relatively small movement of the manual lever, whereas, at the end of the closing operation, a large movement of the manual lever leads only to a relatively small movement of the clamping lever. As a result, it is possible to transmit high clamping forces, and therefore even connecting conductors having large cross sections can be securely and reliably contacted.

In addition, it is possible reliably and securely to connect conductors of different cross sections.

In a preferred embodiment, the manual lever and the clamping lever are arranged in such a manner that self-locking of the clamping state is brought about. In this configuration, if the manual lever is transferred from the open state into the clamping state, a dead center is exceeded. In the clamping state, the manual lever is in such a position, in which first of all force has to be applied again in order to transfer the manual lever from the clamping state into the open state.

In particularly preferred configurations, at least one auxiliary lever is provided, said auxiliary lever connecting the manual lever pivotably to the holder. Two auxiliary levers are preferably provided, said auxiliary levers being arranged, in particular symmetrically, on both housing sides or on both sides of the holder. By means of the at least one auxiliary lever, a particularly effective transmission ratio and a dynamic change of the transmission ratio are possible.

Particularly preferably, one side of the auxiliary lever is held pivotably on the holder. Another side of the auxiliary lever is preferably connected pivotably to the manual lever. It is possible in this case for the pivot points of the auxiliary lever to be arranged in each case in the vicinity of the respective ends of the auxiliary lever. However, it is also possible for the pivot points on the one side and on the other side of the auxiliary lever to be at a considerable distance from the respective end of the auxiliary lever.

In particularly preferred refinements, the manual lever is connected pivotably at one end to the clamping lever and is connected pivotably at another end to the auxiliary lever. Within the context of the present application, the term "at the end" should also be understood as meaning a clear distance from the absolute end of the manual lever. Thus, distances of 20 or 30% of the entire length from the respective pivot point are possible. The overall length is determined here from the length required functionally for the pivoting movement and therefore the definition of the ends refers to the length required functionally for the pivoting operation.

Such a configuration, in which the auxiliary lever is connected pivotably at the sides or ends thereof to the holder or to the manual lever and in which the manual lever in turn is connected to the clamping lever and the auxiliary lever, results in a particularly advantageous embodiment which permits simple operation with very high clamping forces.

In preferred embodiments, the clamping unit comprises at least one clamping foot and/or comprises at least one clamping serration and/or at least one clamping point. For example, it is possible for the clamping unit to comprise a clamping foot or a plurality of clamping feet, wherein each clamping foot has a clamping serration or a plurality of clamping serrations which result in a particularly secure support of the clamped conductor at the electrical connection terminal. However, it is also possible for clamping points to be provided in addition to the clamping serrations or instead of the clamping serrations, said clamping points digging into the material of the conductor in order to achieve a high degree of security against being pulled out.

In all of the configurations, it is preferred for at least one spring device to be provided in order to counteract settling phenomena. It is possible here for the electrical connection terminal itself or at least some parts or components thereof to bring about or at least to contribute to the spring action of the spring device.

The spring action of the spring device is particularly preferably at least partially produced by at least one component from a group of components, wherein said group of components comprises the holder and the manual lever and the auxiliary lever. For example, the entire spring action can be produced by the connection terminal itself and by the involved components without there being a spring, for example, in the form of a spiral or leaf spring or the like. The housing itself and the involved components of the electrical connection terminal provide a very high degree of spring rigidity which ensures reliable support even in the case of large conductor cross sections. Settling phenomena are reliably compensated for.

In preferred developments, it is possible and preferred for the spring device to have at least one clamping spring, wherein at least one clamping spring is preferably provided on the clamping unit. It is also possible and preferred for a plurality of clamping springs, which are designed in particular as leaf springs, to be provided on the clamping unit. Leaf springs of this type, in particular arranged in parallel, increase the spring force with increasing deflection, and therefore a greater spring force is applied in the case of large conductor cross sections than in the case of smaller conductor cross sections.

In addition to or instead of clamping springs on the clamping unit and in particular on the clamping foot of the clamping lever, at least one spring unit which in particular presses from below against the current bar can also be provided. For example, the clamping unit can be provided above the current bar and the spring unit can be arranged below the current bar. In such a configuration, pressure is exerted from above by the clamping unit on the conductor located between the clamping unit and the current bar, while the current bar is pressed against the conductor from below by the spring unit.

It is also possible for the conductor to be pushed in under the current bar, and therefore the current bar is pressed against the conductor by the clamping unit.

It is particularly preferred if the manual lever has a tool receptacle. For example, the manual lever can have an insertion opening for a tool, and therefore a tool, such as, for example, a screwdriver or the like, can be introduced into the manual lever. The effective length of the manual lever is thereby extended, and therefore a considerably greater force can be applied by the manual lever. At the same time, the operation is facilitated by introducing a tool into the manual lever.

In all configurations, it is preferred for the manual lever and/or the holder and/or the auxiliary lever to consist substantially or even entirely in each case of one or more bent metal strips. Such a configuration permits a stable construction of the connection terminal according to the invention, wherein the production is simple and cost-effective.

The holder preferably has at least one stop for the auxiliary lever and/or the manual lever. As a result, a defined closing position is provided, since the manual lever has to be moved until the auxiliary lever and/or the manual lever itself strikes against the stop of the holder.

It is also possible to provide at least one stop for the open state in order to limit the opening movement. In all configurations, it is particularly preferred for a high force transmission to be present at the end of the closing operation in order to transmit the force applied to the manual lever in a considerably boosted manner to the clamping lever.

The manual lever is particularly preferably accommodated on the clamping lever in such a manner, and the auxiliary lever is connected to the manual lever and to the holder in such a manner that a dynamic transmission of the displacement ratios takes place during the closing and during the opening.

In all configurations, at least one insulating layer and/or an insulating housing are preferably provided in order outwardly to insulate the electrical connection terminal.

The proposed electrical connection terminal provides a tilting lever terminal with a dynamic lever transmission, wherein, as the terminal is pivoted shut, the current conductor located in the connection terminal is pressed onto the current bar. The dynamic lever transmission means that, in an upper pivoting region in which a great force is not required, in particular a lever step-down ratio is provided. This means that a small pivoting movement of the manual lever brings about a relatively large pivoting movement of the clamping lever. In the region in which the conductor is clamped, a sliding lever transmission arises, and therefore a large pivoting movement of the manual lever brings about a relatively smaller movement of the clamping lever. In a corresponding manner, a greater compressive force is applied to the conductor. The use of spring elements permits a certain degree of elasticity in the construction and therefore also operation with different conductor cross sections. At the same time, the settling behavior of the conductor is compensated for. A secure clamped state is achieved by overcoming a dead center.

Further advantages and features of the present invention emerge from the description of the exemplary embodiment which is explained below with reference to the attached figures.

Figure 1:
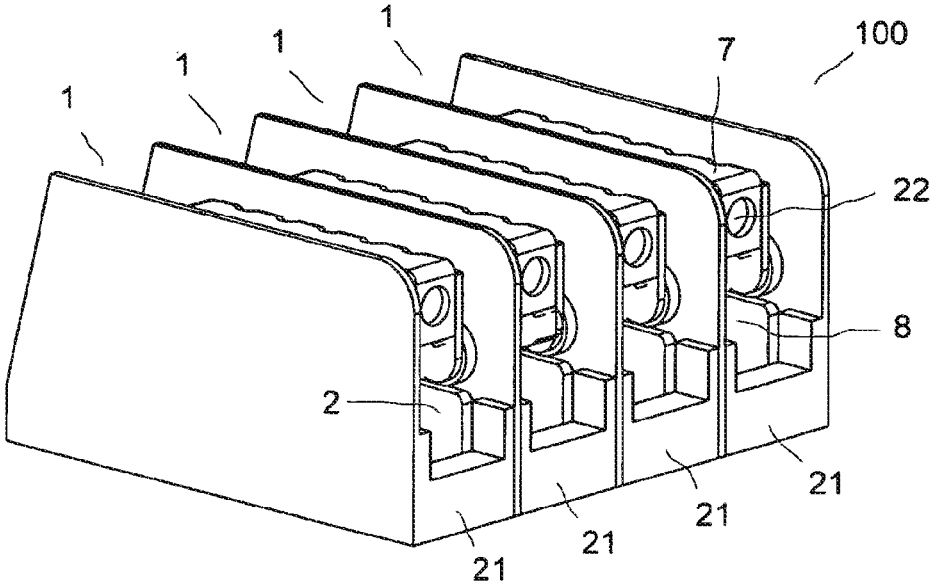
FIG. 1 shows a schematic illustration of a series terminal with a plurality of electrical connection terminals according to the invention.

FIG. 1 shows a series terminal 100 according to the invention with a plurality of electrical connection terminals 1 according to the invention, which are each designed here as a tilting lever terminal and have dynamic lever transmission. Each individual connection terminal 1 has an insulating housing 21, which can be designed as a single-part housing or else consists of a plurality of individual parts, in order to bring about the desired electrical insulation effect.

A manual lever 7 serves for actuating each individual electrical connection terminal 1. In the clamped state, a conductor which is not illustrated in FIG. 1 is accommodated in a firmly clamped manner in the conductor receiving space 8.

In order to actuate the manual lever 7, a tool receptacle 22 is provided on the manual lever 7. The tool receptacle here comprises an opening at the front end of the manual lever 7, through which a tool, such as, for example, a screwdriver, can be introduced into the manual lever 7. A slot 24 is provided at the rear end of the manual lever, said slot not being visible here in FIG. 1 and to which the tool can be fixed such that the manual lever 7 is moved by a pivoting movement of the screwdriver. As a result, considerably more force can be applied via the manual lever 7 than if a tool or a rod or the like were not introduced.

Figure 2:
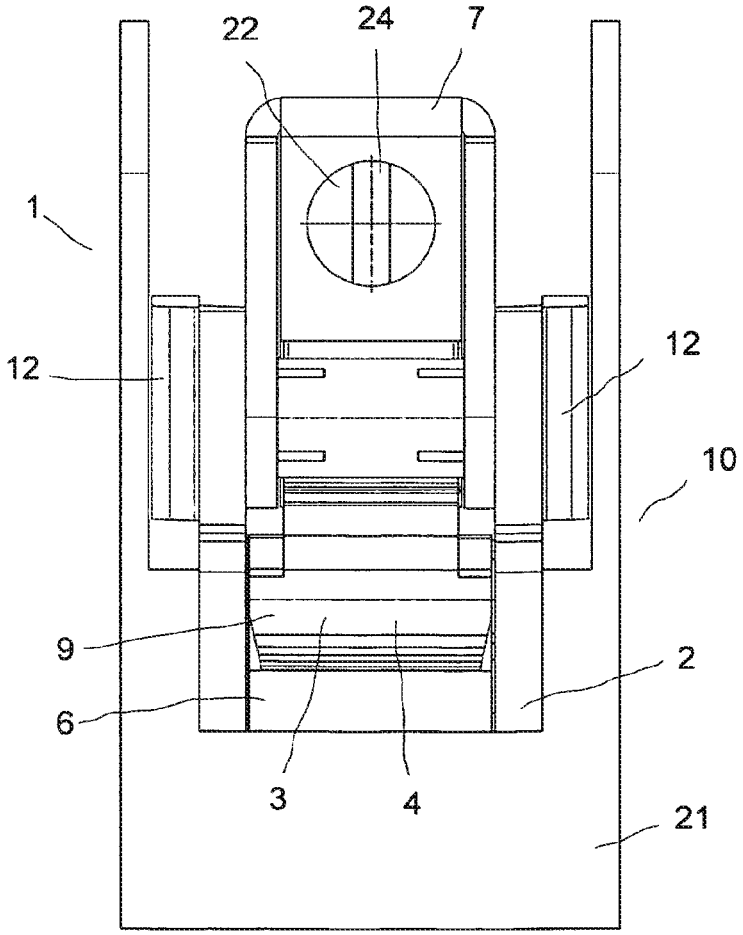
FIG. 2 shows a front view of an electrical connection terminal.

FIG. 2 shows a front view of an electrical connection terminal 1 according to the invention, which can be used individually or else is part of the series terminal 100 from FIG. 1.

The connection terminal 1 is surrounded on the outside by the insulating housing 21. The connection terminal 1 has a holder 2 on which a clamping lever 3 is pivotably arranged. The clamping lever 3 has a clamping unit 4 which here comprises a clamping foot 9. With the clamping foot 9, a conductor introduced into the conductor receiving space 8 is accommodated in a clamping manner between the clamping foot 9 and the current bar 6.

As is visible in FIG. 2, the manual lever 7 has a tool receptacle 22 with an opening through which the slot 24 at the rear end of the manual lever 7 is visible. A screwdriver introduced into the opening 22 can be latched into the slot 24 and therefore permits defined guidance of the manual lever 7 via the pivoting movement of the introduced screwdriver.

The manual lever 7 is connected here to the holder 2 via two auxiliary levers 12. The function of said components is explained in more detail with reference to the further figures.

Figure 3:
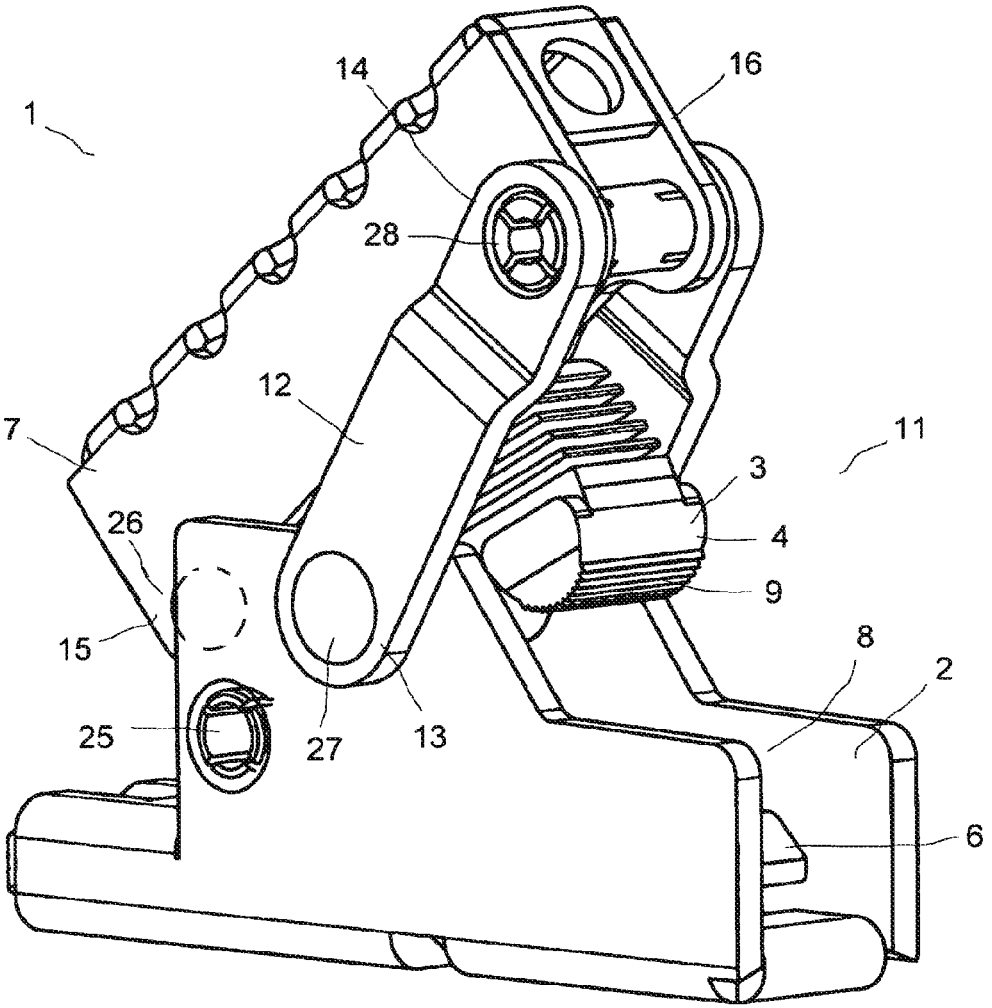
FIG. 3 shows a perspective view of an open connection terminal according to FIG. 2.

FIG. 3 shows a perspective view of a connection terminal 1 without the insulating components surrounding the connection terminal 1. A current bar 6 is accommodated on the holder 2. The clamping lever 3 is accommodated pivotably on the holder 2 via a pivot axis 25. FIG. 3 illustrates a partially open state 11 in which the clamping lever 3 has been pivoted upward a considerable distance. The clamping lever 3 is pivotable via the pivot axis 25.

A pivot axis 26 which is the rear pivot axis 26 of the manual lever is provided on the pivot lever 3. In addition, the manual lever 7 is accommodated at the front pivot axis 28 so as to be pivotable in relation to the two auxiliary levers 12. Each auxiliary lever 12 is accommodated on one side 13 on the holder 2 so as to be pivotable via the pivot axis 27, while on the other side 14 of the auxiliary lever 12 the pivot axis 28 is provided as the front pivot axis of the manual lever 7.

The overall result is four points of articulation via which four components, namely the holder 2, the clamping lever 3, the manual lever 7 and the auxiliary lever or the auxiliary levers 12 are connected to one another in an articulated manner. In this case, the distance between the pivot axes 27 and 28 of an auxiliary lever 12 is smaller than the distance between the pivot axes 26 and 28 of the manual lever 7. The distance between the pivot axes 25 and 27 on the holder 2 is in turn greater than the distance between the pivot axes 25 and 26 on the clamping lever 3.

A dynamic adaptation of the transmission ratio of the lever movement and of the lever forces is brought about by the selection of the geometry and of the individual lengths. At the beginning of the closing operation, a relatively small movement of the manual lever 7 brings about a relatively large closing movement of the clamping lever 3, while, at the end of the closing operation, a relatively large movement of the manual lever 7 leads only to a relatively small closing movement of the clamping lever 3, and therefore a high force transmission is achieved toward the end of the closing operation.

Figure 4:
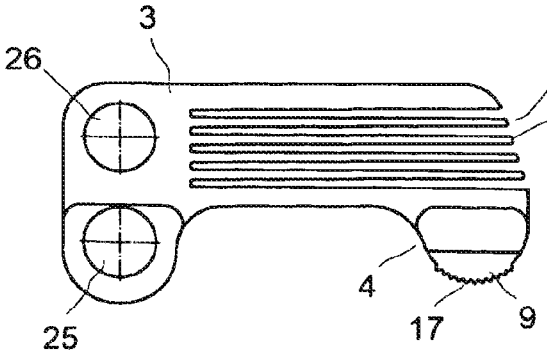
FIG. 4 shows the clamping lever of the connection terminal according to FIG. 3 in a side view.

FIG. 4 shows the clamping lever 3 in a lateral illustration. The clamping unit 4 with the clamping foot 9 is arranged at the front end of the clamping lever 3, wherein clamping serrations 17 are provided on the clamping foot 9 in order to increase the protection against being pulled out.

In order to achieve and reinforce a resilient action, a spring device 18 is provided here, said spring device having a plurality of clamping springs 19 which are designed here as leaf springs and extend parallel to one another.

The clamping lever 3 is provided pivotably via the pivot axis 25, wherein a through hole is provided here in the clamping lever 3. The pivot axis 26 for pivoting the manual lever 7 here comprises axle stubs on the outer side of the clamping lever 3. Corresponding openings of the manual lever 7 are plugged onto said axle stubs in order to connect the manual lever 7 to the clamping lever 3 so as to be pivotable about the pivot axis 26.

Figure 5:
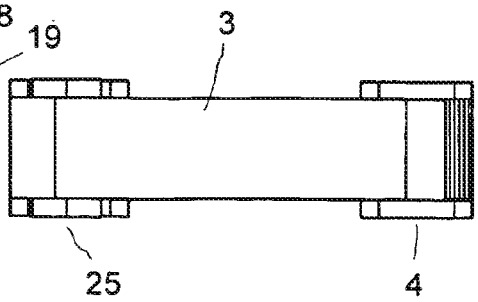
FIG. 5 shows the clamping lever according to FIG. 4 in a top view.

FIG. 5 shows a corresponding top view of the clamping lever 3.

Figure 6:
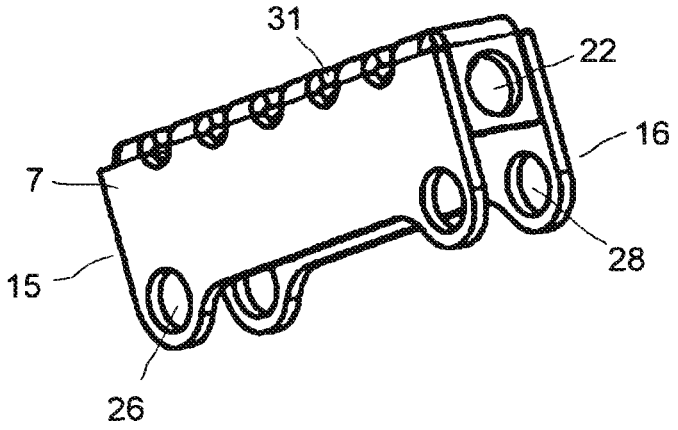
FIG. 6 shows the manual lever of the connection terminal according to FIG. 3 in a perspective view.

FIG. 6 shows a slightly perspective view of the manual lever 7, wherein the bores or holes on the pivot axes 26 and 28 can clearly be seen. The pivot axis 26 is provided at the rear or one end 15 of the manual lever 7, while the pivot axis 28 of the manual lever 7 is arranged at the front or other end 16. The manual lever 7 consists here overall of a bent metal strip, but can also consist of different materials. In order to facilitate the bending process, holes 31 can be provided at the bending edges.

Figure 7:
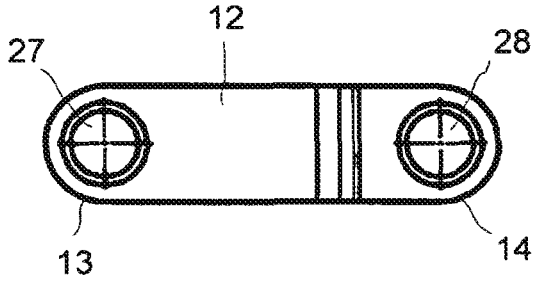
FIG. 7 shows a side view of the auxiliary lever of the connection terminal according to FIG. 3.

FIG. 7 shows a side view of an auxiliary lever 12, in which the pivot axis 27 is provided on one side 13 or at one end, while the pivot axis 28 is provided on the other side 14 or at the other end. On the two pivot axes, holes are provided here in the auxiliary lever 12, said holes being plugged onto corresponding axle stubs on the holder 2 and on the clamping lever 3 in order to connect the components to one another so as to be pivotable in relation to one another.

Figure 8:
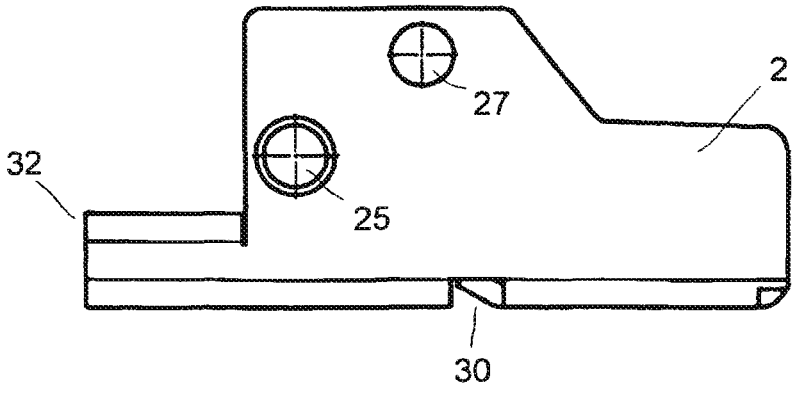
FIG. 8 shows the holder of the electrical connection terminal according to FIG. 3.

FIG. 8 shows a side view of the holder 2 which, instead of the pivot axis 25, has a bore here, while, instead of the pivot axis 27, axle stubs protrude laterally from the holder 2. The current bar 6 is clamped at one end by a bent-over portion 32 of the holder.

Figure 9:
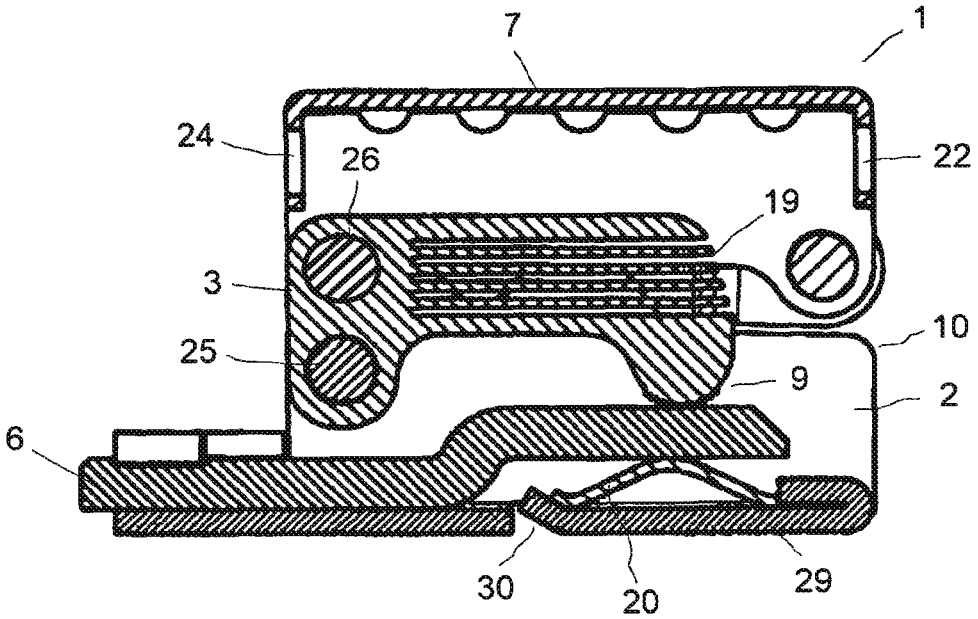
FIG. 9 shows the electrical connection terminal according to FIG. 3 in a cross section in the closed state.

The sliding stop 30 is explained with reference to FIG. 9. FIG. 9 shows a cross section through a fitted connection terminal 1 in the clamping state 10. The current bar 6 is secured by the bent-over portion 32 on the holder 2. The clamping lever 3 is accommodated pivotably in relation to the holder 2 via the pivot axis 25, and therefore, by means of a pivoting movement of the clamping lever 3 counter-clockwise, the clamping state 10 illustrated in FIG. 9 is departed from and the terminal is transferred, for example, into the open state 11 illustrated in FIG. 3. The clamping springs 19 at the front end, where the clamping foot 9 is arranged, can be seen clearly.

The pivot axis 26 which, for the one auxiliary lever 12, is located spatially in front of the sectional plane, and for the other auxiliary lever 12, is located behind the sectional plane is shown here merely by dashed lines.

A spring unit 20 which presses from below against the current bar 6 is provided below the current bar 6. The spring unit 20 is designed here as a bent sheet-metal strip and is clamped to the stop 29 by being bent over, while the spring unit can slide resiliently upward over the slope at the stop 30 in order to produce the spring action.

Figure 10:
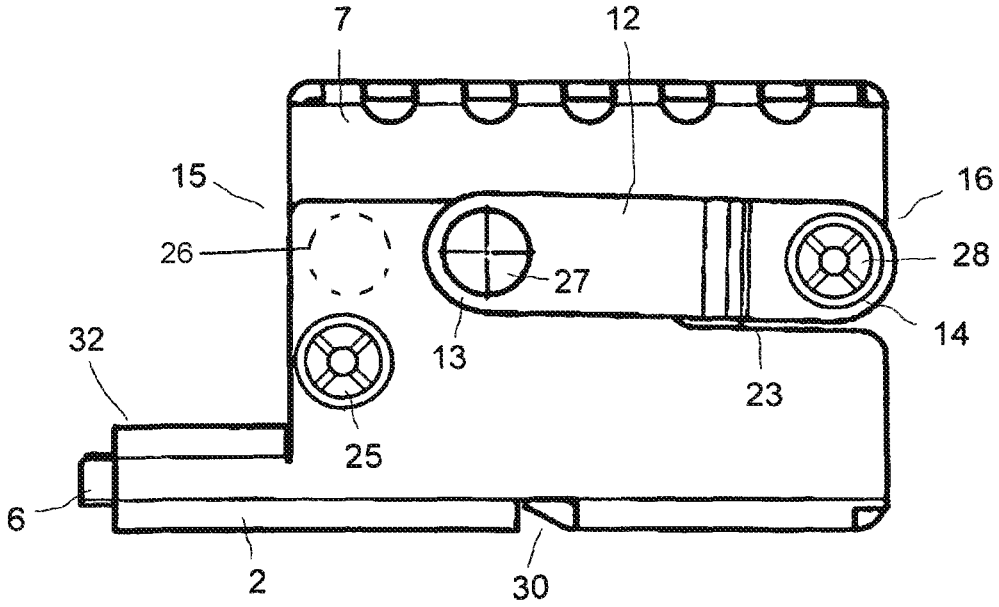
FIG. 10 shows a side view of the connection terminal according to FIG. 9 in the unsectioned state.

FIG. 10 shows the unsectioned state of the connection terminal 1 according to FIG. 9 in the clamped state 10.

In this state, the auxiliary lever 12 rests over part of the lever length thereof on the stop 23 of the holder. The stop 23 constitutes an end stop which defines the clamped state. In this position, a self-locking position of the manual lever 7 and of the clamping lever 3 arises. During the movement from the open state 11 into the clamping state 10, a dead center is exceeded, and therefore, in order to release said state, effort is initially required.

The function of the electrical connection terminal 1 during the closing operation is explained with reference to FIGS. 11 to 13.

Figure 11:
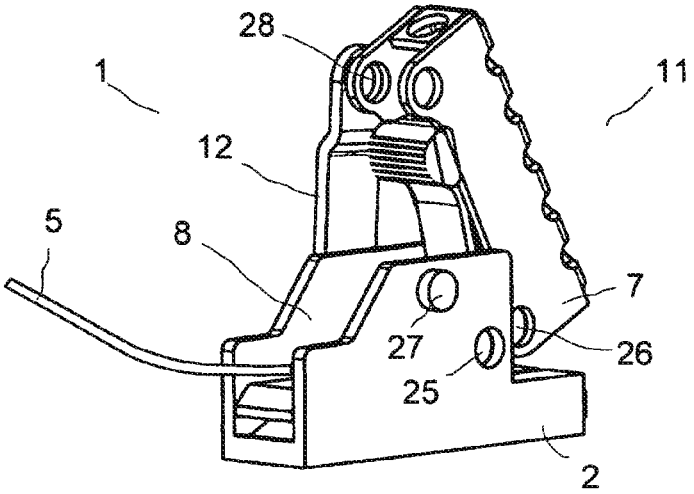
FIG. 11 shows the connection terminal according to FIG. 3 in a wide open state.

FIG. 11 shows a wide open state 11 in which it is very simple to pivot in a conductor 5 to be connected from above. In this case, the conductor 5 does not have to be bent and introduced through a front opening but rather can simply be pivoted in from above into the wide open connection terminal 1 until the conductor approximately rests on the current bar 6.

Figure 12:
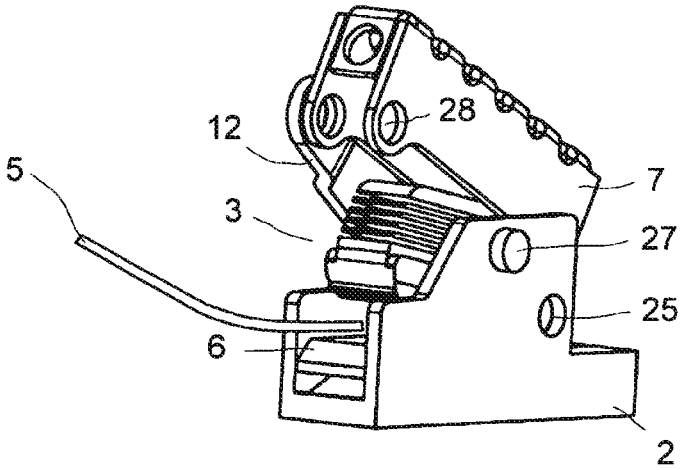
FIG. 12 shows the connection terminal according to FIG. 3 in a partially closed state.

Subsequently, for example, after a tool is introduced into the tool receptacle 22, the manual lever 7 is pivoted from the open state in the direction of the clamping state, as a result of which, initially in an accelerated manner, the clamping lever 3 is pivoted from the wide open state according to FIG. 11 into a partially open state, as illustrated in FIG. 12.

Figure 13:
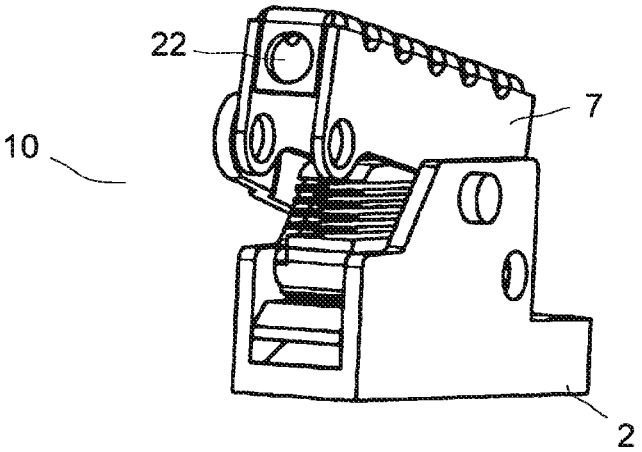
FIG. 13 shows the connection terminal according to FIG. 3 in a virtually closed state.

For the sake of clarity, some components have been omitted in FIGS. 11 to 13. In particular, only one of the auxiliary levers 12 is shown.

In contrast to the state illustrated in figure, in the state illustrated in FIG. 12, the manual lever has been moved relatively little whereas the clamping foot 9 of the clamping lever 3 has already moved a considerable distance toward the current bar 6.

During the further movement of the manual lever 7 in the direction of the clamping state 10, the clamping foot 9 of the clamping lever 3 still only moves a relatively small amount, as a result of which a relatively high force transmission is brought about. The clamping force applied to the manual lever 7 is transmitted on an enlarged scale to the clamping foot of the clamping lever. As a result, high clamping forces are possible.

By means of the resilient action of the individual components, conductor cross sections of different size can be reliably and securely clamped, which permits a secure and simple operation of the electrical connection terminal 1. The clamping springs 19 permit a defined spring action.

Separate latching is not required in the electrical connection terminal 1 since, by overcoming the dead center during the pivoting movement from the open state 11 into the clamping state 10, self-locking is achieved.

| List of reference numbers | |
|---|---|
| Electrical connection terminal | 1 |
| Holder | 2 |
| Clamping lever | 3 |
| Clamping unit | 4 |
| Conductor | 5 |
| Current bar | 6 |
| Manual lever | 7 |
| Conductor receiving space | 8 |
| Clamping foot | 9 |
| Clamping state | 10 |
| Open state | 11 |
| Auxiliary lever | 12 |
| One side | 13 |

-continued

| List of reference numbers | |
|---|---|
| Other side | 14 |
| One end | 15 |
| Other end | 16 |
| Clamping serration | 17 |
| Spring device | 18 |
| Clamping spring | 19 |
| Spring unit | 20 |
| Insulating housing | 21 |
| Tool receptacle | 22 |
| Stop | 23 |
| Slot | 24 |
| Pivot axis | 25 |
| Pivot axis | 26 |
| Pivot axis | 27 |
| Pivot axis | 28 |
| Stop | 29 |
| Stop | 30 |
| Hole | 31 |
| Bent-over portion | 32 |
| Series terminal | 100 |

The invention claimed is:

1. An electrical connection terminal comprising a holder and at least one clamping lever which is arranged pivotably on said holder and has at least one clamping unit for clamping at least one conductor between the clamping unit and a current bar, wherein a manual lever is provided, said manual lever being accommodated pivotably on the clamping lever in order to permit a dynamic transmission ratio during the closing operation and a high clamping force wherein an auxiliary lever is provided, said auxiliary lever connecting the manual lever pivotably to the holder.

2. The connection terminal as claimed in claim 1, wherein the manual lever and the clamping lever are arranged in such a manner that self-locking of the clamped state is brought about.

3. The connection terminal as claimed in claim 1, wherein the auxiliary lever is held pivotably on one side on the holder and is connected pivotably on another side to the manual lever.

4. The connection terminal as claimed in claim 1, wherein the manual lever is connected pivotably at one end to the clamping lever and is connected pivotably at another end to the auxiliary lever.

5. The connection terminal as claimed in claim 1, wherein the clamping unit comprises at least one clamping foot.

6. The connection terminal as claimed in claim 1, wherein at least one spring device is provided by the members of the 4-bar linkage.

7. The connection terminal as claimed in claim 6, wherein at least one component contributes to the elastically biasing the clamping lever toward the current bar, wherein the at least one component is taken from a group of components consisting of the holder and the manual lever and the auxiliary lever.

8. The connection terminal as claimed in claim 1, wherein the clamping unit is provided above the current bar, and further comprising at least one spring unit is provided below the current bar.

9. The connection terminal as claimed in claim 1, wherein the manual lever has a tool receptacle.

10. The connection terminal as claimed in claim 1, wherein at least one of the manual lever, the holder, and the auxiliary lever substantially consists of a bent metal strip.

11. The connection terminal as claimed in claim 1, wherein the holder has at least one stop for the auxiliary lever and/or the manual lever.

12. The connection terminal as claimed in claim 1, wherein there is a high force transmission at the end of the closing operation.

13. The connection terminal as claimed in claim 1, wherein the manual lever is accommodated on the clamping lever in such a manner, and the auxiliary lever is connected to the manual lever and to the holder in such a manner that a dynamic transmission of the displacement ratios takes place during the closing.

14. An electrical connection terminal comprising:

a holder;

at least one clamping lever which is arranged pivotably on said holder; and;

at least one clamping unit for clamping at least one conductor between the clamping lever and a current bar, wherein the at least one clamping unit comprises:

a manual lever pivotably connected to the clamping lever; and an auxiliary lever pivotally connecting the manual lever to the holder, forming a 4-bar linkage in combination with the manual lever, the clamping lever and the holder;

wherein the 4-bar linkage can toggle between a clamped state with the clamping lever elastically biased toward the current bar, when the manual lever is in a lowered position, and a unclamped state when the manual lever is in a raised position, resulting in an a dynamic transmission ratio during the closing operation and a high clamping force.

* * * * *